United States Patent [19]

Libit

[11] 4,436,225

[45] * Mar. 13, 1984

[54] DISPENSER HAVING A TRIGGER-BULB PUMP

[76] Inventor: Sidney M. Libit, 441 Lakeside Ter., Glencoe, Ill. 60022

[ * ] Notice: The portion of the term of this patent subsequent to Oct. 5, 1999 has been disclaimed.

[21] Appl. No.: 378,805

[22] Filed: May 17, 1982

Related U.S. Application Data

[63] Continuation of Ser. No. 162,429, Jun. 24, 1980, Pat. No. 4,352,443.

[51] Int. Cl.[3] ..... B05B 11/01

[52] U.S. Cl. ..... 222/207; 222/383

[58] Field of Search ..... 222/207, 383, 214, 79, 222/372, 562; 92/87

[56] References Cited

U.S. PATENT DOCUMENTS

| | | | |
|---|---|---|---|
| 1,085,472 | 1/1914 | Parker | 222/79 |
| 3,486,663 | 12/1969 | Humphrey | 222/207 |
| 3,561,648 | 2/1971 | Humphrey | 222/207 |
| 3,648,902 | 3/1972 | Humphrey | 222/207 |
| 3,986,644 | 10/1976 | Grogan et al. | 222/207 |
| 3,995,774 | 12/1976 | Cooprider et al. | 222/207 |
| 3,995,776 | 12/1976 | Michallef | 222/207 |

FOREIGN PATENT DOCUMENTS

| | | | |
|---|---|---|---|
| 948312 | 7/1949 | France | 222/79 |

*Primary Examiner*—David A. Scherbel

*Attorney, Agent, or Firm*—Laff, Whitesel, Conte & Saret

[57] ABSTRACT

A pump for bottles, cans, containers, and the like, which dispenses a fluid mist or spray. The pump has a spray head with a series of cavities forming passageways leading from a tube, which extends down into the bottle, can or other container to a jet-orifice at a spray-dispensing nozzle. Between two of the cavities is a trigger-bulb which expands, after compression, under the force of a plastic memory to suck fluid from the can or bottle. When the trigger-bulb is again squeezed, or otherwise actuated, the fluid is forced out the jet-orifice at the nozzle. The upper edge walls of the trigger-bulb provide the valving action which opens or closes the passageways to control the direction of fluid flow. The breathing air which replaces dispensed fluid in the container, or the like, is controlled by a valve action under the flange. To control the amount of fluid which is dispensed on each pump action, the internal volume of the trigger-bulb may be changed by a molding insert or sleeve in order to reduce its volume. A back-stop anvil limits the rearward travel of the trigger-bulb. In some embodiments, this anvil has a contour which establishes the deformation of the bulb, when it is squeezed.

5 Claims, 10 Drawing Figures

DISPENSER HAVING A TRIGGER-BULB PUMP

This is a continuation of application Ser. No. 162,429 filed June 24, 1980 (now U.S. Pat. No. 4,352,443).

BACKGROUND OF THE INVENTION

This invention relates to pumps and, more particularly, to low-cost pumps for dispensing a mist or spray from bottles and other similar containers.

The term "spray head" is used herein to cover all comparable devices without regard as to whether they actually deliver a stream, spray, mist, or the like.

A dispensing pump is shown in U.S. Pat. No. 3,986,644, but this pump requires a number of separate parts, which add cost for tooling, manufacturing and labor. Also, if a pivoted trigger action is used, it may possibly experience binding, misalignment, or other similar failure. If a trigger action is not provided, the pump is less convenient to use.

Another disadvantage of the structure of U.S. Pat. No. 3,986,644 is that is includes a flap valve which opens when fluid is drawn from the bottle and closes when fluid is expelled from the spray head. The flap valve is sensitive so that it may open if the bottle lays on its side or is upside down. Also, if the fluid is somewhat viscous, it tends to hold the flap valve open. For these reasons, pumps following the teachings of this patent generally have a twin cap on the spray end which must be closed for storage to keep the fluid from leaking out of the bottle when it is in any but an upright position.

Accordingly, an object of the invention is to provide new and improved pumps for dispensing mists or sprays responsive to a trigger-like action, without simultaneously requiring a plurality of mechanically working parts which are subject to binding, misalignment, and other similar problems.

Another object of the invention is to provide a pump which does not leak if the bottle is in any position other than the normal upright position. Here, an object is to avoid having to close the spray head during storage in order to prevent leakage. Conversely, an object is to provide quick close/quick open convenience closure device when a positive closing is necessarily or desirable. In this connection, an object is to avoid requiring an unduly sensitive flap valve.

Yet another object of the invention is to provide pumps for dispensing a mist or spray from bottles or similar containers, which pumps may be made from low-cost, easily molded materials, especially plastic materials. Here, an object is to reduce both the number of parts and the amount of labor which are required to assemble a pump.

Further, an object of the invention is to provide pumps which may be adapted to dispense different volumes of fluids, without requiring substantial tooling changes. Other objects will be apparent from the description, drawings and claims.

SUMMARY OF THE INVENTION

In one form, the invention includes a unitary spray head with a flexible, plastic bulb integrally dependent from a mounting flange, the bulb built somewhat like a trigger. When the trigger-bulb is pulled, the bulb at least partially collapses to squeeze fluid therefrom and out a nozzle at the end of the spray head. When the trigger-bulb is released, the memory in the bulb plastic causes it to return to full volume, thereby sucking fluid from a bottle associated with the spray head. The contours of the mounting flange in association with its supporting structure automatically provide the necessary valving. Thus, in the relaxed condition, a fluid passage adjacent a first side of the mounting flange, is opened between the bulb and the contents of the bottle. At the same time, the mounting flange closes both the fluid passage to the spray head and an air passage into the bottle. In the squeezed condition, the other side of the mounting flange is pulled away from a fluid passage to the spray head while the first side is pressed to close the fluid passage into the bottle. This pressing sufficiently relaxes the bottom of the mounting flange on the first side to open an air passage under it, leading into the bottle.

DESCRIPTION OF A PREFERRED EMBODIMENT

Figure 1:
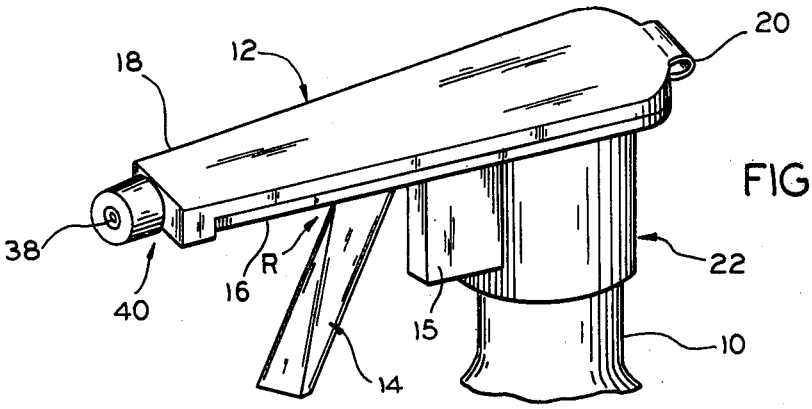
FIG. 1 is a perspective view of the neck of a bottle with the inventive spray head attached thereto.

The major assemblies of a pump for dispensing a mist or spray are shown in FIG. 1 and include a bottle 10, a spray head 12, a trigger-bulb 14 and a stop or anvil 15 for limiting the trigger motion at the end of its backstroke. In effect, the neck of bottle 10 forms a pistol-like handle and may take any convenient form. For present purposes, it is assumed to be a member having a threaded top for receiving a screw cap. However, other convenient and suitable forms of bottle closures may be used. Also, "child-proof" tops may be used to prevent accidental dislodgment of the cap.

Figure 2:
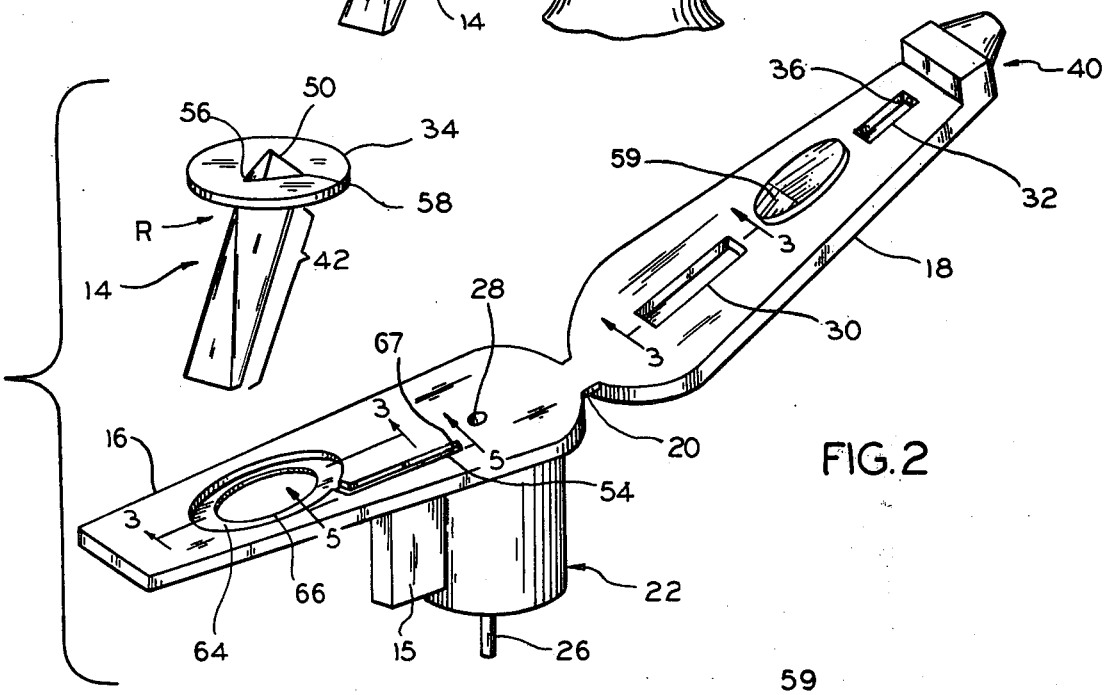
FIG. 2 is an exploded view of the inventive spray head of FIG. 1.

The details of the spray head 12 are best seen in FIG. 2. The spray head is here shown as a unitary member having two parts 16,18, preferably joined together with a living hinge 20 formed at any convenient location, such as on the front, back or sides. In this embodiment, the hinge 20 is shown on the back of the spray head. The two parts 16,18 could also be completely separate parts, without any hinge.

Dependent from lower part 16 of the spray head is a connector 22 of any suitable design. If the bottle 10 has a threaded neck, the connector 22 is a threaded cap. If the bottle employs a snap-on, circumferential, outside rim, the connector 22 will have a mating snap-on, circumferential, inside rim.

At any suitable location, a back stop or anvil 15 may be positioned to limit the rearward travel of the trigger 14. As here shown, it may conveniently be molded unitarily into the spray head itself. However, it could also be part of the bottle 10.

The bottom half 16 of the spray head 12 has a hollow tube 26 extending from a hole 28 on the upper surface of member 16 to a point near the bottom of the bottle. Fluid pumped from the bottle travels from that point near the bottom of bottle 10, up tube 26, and out the hole 28.

Figure 10:
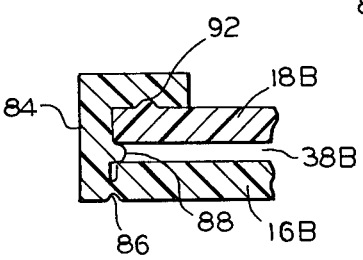
FIG. 10 shows the same closure device in a closed position.
Figure 9:
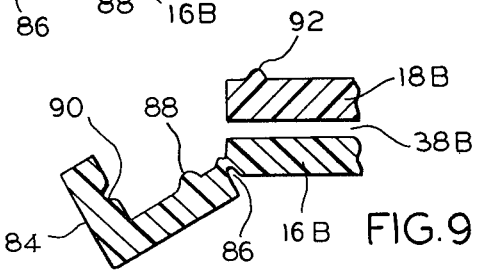
FIG. 9 shows, in cross section, the tip end of the spray nozzle with quick close/quick open convenience closure device in an open position.

In this embodiment, the lower surface of the upper half 18 of the spray head 12, has two cavities 30,32. When the spray head is closed, the cavity 30 extends from a point over the hole 28 to a point over a flange 34 on the trigger-bulb 14. The cavity 32 extends from a point over the trigger-bulb flange 34 to a hole 36 of any suitable configuration at one end of a passageway leading to a jet-orifice 38 on the nozzle end 40 on the spray head. In the interest of reducing molding costs, hole 36 might be formed as a groove extending from cavity 32, along the lower surface of part 18 or the upper surface of part 16, to orifice 38. Such a groove is seen in FIGS. 9, 10.

Figure 7:
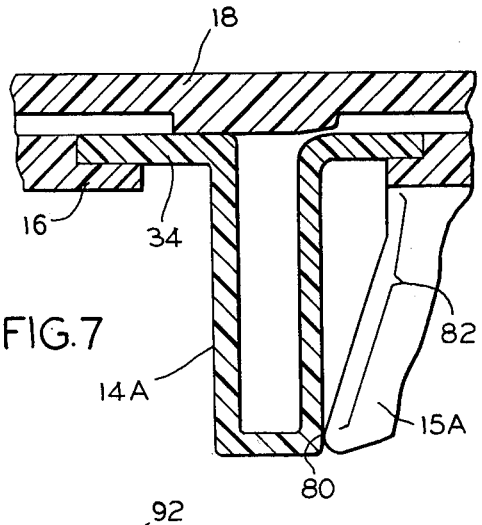
FIG. 7 shows, in a relaxed condition, a second embodiment of the trigger-bulb used in conjunction with an anvil or stop means having a profile which insures a more orderly emptying of the bulb.
Figure 8:
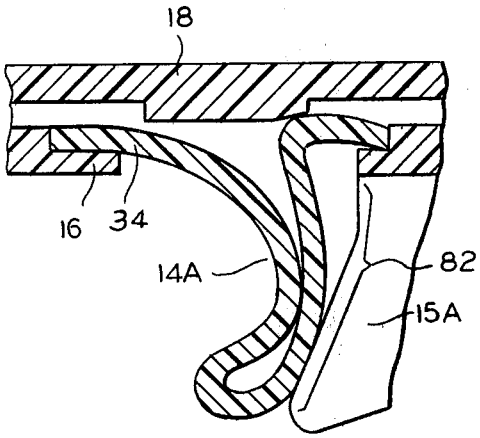
FIG. 8 shows the trigger bulb of FIG. 7 in a fluid propellant condition.

The trigger-bulb 14 integrally comprises a dependent portion 42 and a flange part 34. The dependent portion 42 is a hollow bulb of any convenient dimensions, which provides a handy trigger action and defines a fixed volume of fluid displacement. The trigger 14 is positioned in a convenient location with respect to the handle formed by the neck of the bottle. More particularly, in the embodiment shown in FIGS. 1–4, the trigger-bulb 42 may be set so that, when relaxed, it projects forwardly, at an angle A (FIG. 3) which is in the nature of 30° off the vertical, for example. While shown canted, the trigger-bulb may also be perpendicularly mounted as shown in FIGS. 7, 8, if desired.

The trigger-bulb is shown as essentially being triangular in cross section in region R, where the trigger finger curls around it. From this triangular cross section, the shape of the preferred trigger-bulb resolves itself into a generally rectangular section near the bottom. The bulb may also have any other suitable shape. When the triangular-shaped cross section is set with the apex of the triangle projecting forward to be engaged by the finger, there is a more trigger-like "feel." Also the broad dimension at the base of the triangle helps the trigger-bulb bend in a plane toward anvil 15, rather than to cant off to one side or the other of the anvil.

Figure 5:
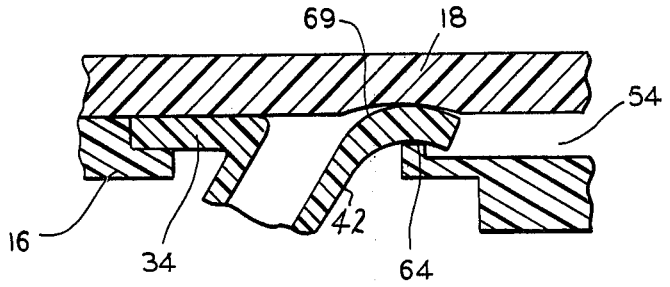
FIG. 5 is a first stop-motion, cross-sectional view of part of the spray head taken along line 5—5 of FIG. 2 and showing an air breather valve in a closed position.
Figure 6:
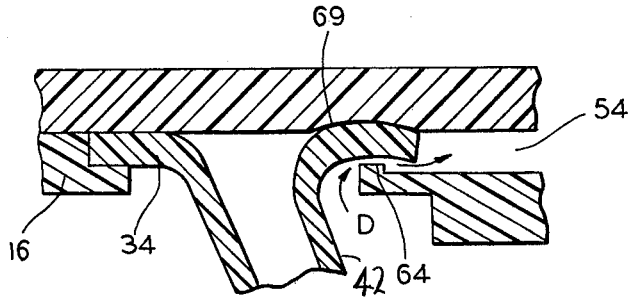
FIG. 6 is a second and similar stop-motion view showing the air breather valve in an open position.

The interior surface of dependent bulb 42 may or may not have a thickened, spiral rib 44 (FIGS. 3,4) which gives extra body to the bulb without loss of flexibility and gives a feel of a trigger instead of a balloon-like object. When used, rib 44 provides added plastic memory for restoring the bulb to full volume after activation, thereby sucking fluid from the bottle. In the embodiment of FIGS. 5 and 6, the bulb is shown with no internal rib to illustrate that type of construction.

Preferably, the volume of trigger-bulb 14 is made in a mold which is the largest that is likely to be required. If it is desirable to reduce the volume of fluid pumped by each trigger-bulb squeeze, the trigger-bulb is formed in that mold with an insert or sleeve positioned therein to reduce the bulb volume.

The flange part 34 includes a major opening 50 leading directly into the dependent bulb portion 42. The upper surface of flange 34 may be formed in several different ways. In one form, the upper surface of flange 34 is flat. In another form, it may include oppositely disposed recesses (not shown), which are separated from the major opening 50 by dams or walls. The flange 34 may have a suitable keying shape (here oval) in order to seat flange 34 in a flange seat 64 with an accurate alignment.

Thus, the dependent part 42 may be inserted through a hole 66 in the bottom spray head part 16. The flange 34 fits snugly into the flange seat 64, and the keying shape of the flange and seat insures a proper rotary orientation of parts 16,34. In this orientation, communication is provided between the trigger-bulb 14 and a point near the bottom of bottle 10, via cavity 30, hole 28 (FIG. 2), and tube 26. When the trigger-bulb is actuated, it comunicates through cavity 32 with the jet orifice 38 (FIG. 1).

To enable air to enter the bottle and replace the dispensed fluid, a groove 54 is formed in lower part 16 to extend from an area in flange seat 64 to an area of part 16 containing hole 67 leading into the bottle 10. The groove 54 ends at the vertical wall of the flange seat 64. Therefore, when the flange 34 is resting normally in seat 64, this groove is seated to seal groove 54 against entry of the atmospheric air.

After the flange 34 is properly seated in the flange seat 64, the upper spray head part 18 is folded on hinge 20 over the lower spray head part 16. The two spray head parts 16,18 may have any suitable contours so that they snap together. Thereafter, they may be ultrasonically welded or cemented together. Of course, other unifying methods may also be used. The two parts 16,18 should be sealed together, with due regard for the tendency of the pumped fluid to creep through tiny openings. Thus, suitable O-rings may sometimes be desirable to seal together parts 16,18 in the vicinity of a perimeters around the cavities 30,32.

The operation of the inventive pump valves is best seen in the four stop-motion views of FIGS. 3–6. When the trigger-bulb 14 is relaxed (FIG. 3) and in its normal position, the upper edge wall 58 of the trigger-bulb is standing away from the underside area 59 of upper spray head part 18, thereby forming an open intake valve. Preferably, the area 59 of part 18 is slightly rounded upwardly to provide a smoother and enlarged valve passage. If the trigger-bulb is squeezed and released, the memory in its plastic walls causes it to expand and return to its normal relaxed volume. Therefore, when such expansion occurs, fluid is sucked from the bottle 10 (FIG. 1) up tube 26 (FIG. 2) through hole 28 into cavity 30, over the path indicated by arrow B (FIG. 3), and into the trigger-bulb 42. While the trigger-bulb 42 is relaxed in its normal condition, the opposing upper edge wall 56 of the trigger-bulb is pressed against the underside of part 18, thereby forming a closed outlet valve.

The air-breathing valve action of the relaxed trigger-bulb 42 is seen in FIG. 5. The under surface of upper part 18 is slightly domed at 69 in the area of the breather air valve action where the groove 54 is located. At this time, the flange 34 is lying flat on the flange seat 64, and the breather air groove 54 is sealed.

When the trigger-bulb 14 is pulled (FIG. 4), the upper edge wall 58 of bulb 14 is pressed against the slightly-rounded underside 59 of upper spray head part 18, thereby closing the intake valve by sealing the passageway 30 into the bottle 10. Simultaneously, the trigger-bulb 14 pulls its upper edge wall 56 away from its contact with the underside of the upper spray head part 18, thereby opening the outlet valve. The resulting opening forms a passageway (Arrows C) from the interior of dependent trigger part 42, over the outlet valve formed by the upper edge wall 56, into cavity 32, hole 36 (FIG. 2), and out the jet-orifice 38 (FIG. 1). Thus, the squeezing of trigger-bulb 42 reduces its volume and forces the fluid therein out the orifice 38 of nozzle 40.

The air-breathing valve action responsive to a squeezed trigger-bulb is seen in FIG. 6. More particularly, when the trigger-bulb 14 is squeezed, the deformation of the flange 34, pressed against the domed area 69 on the underside of part 18, relaxes the outer edge of the flange sufficiently to let air leak into the breather air groove 54, which communicates with hole 67 (FIG. 2) and the interior of bottle 10. Thus, the air indicated by arrow D is admitted through groove 54 and hole 67 to replace fluid drawn from bottle 10.

Figure 3:
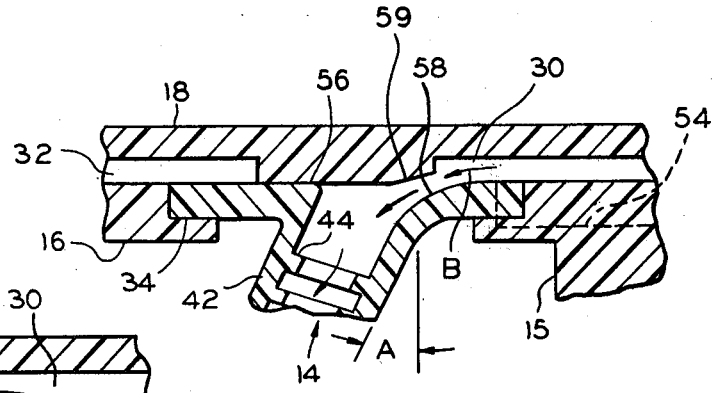
FIG. 3 is a first stop-motion cross-sectional view of a part of the spray head, taken along lines 3—3 of FIG. 2, and showing the liquid dispensing valves in the fill phase of the inventive pump.
Figure 4:
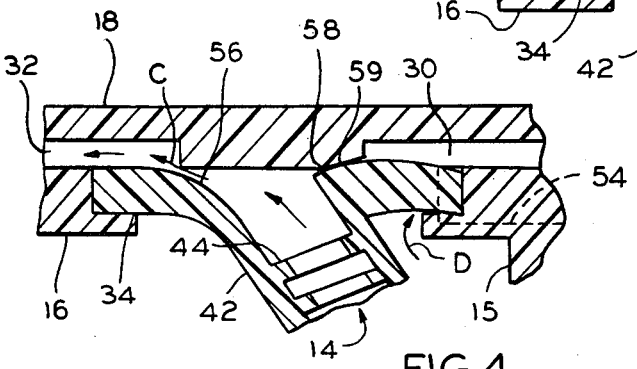
FIG. 4 is a second stop-motion cross-sectional view of the same part of the spray head, showing the liquid dispensing valves in the emptying or propellant phase of the inventive pump.

The release of the trigger 14 causes the dependent part 42 to return to normal, as seen in FIGS. 3 and 5. This return to normal draws more fluid (arrow B) into the trigger-bulb and seals the breather air groove 54.

Other embodiments of the invention may vary the structure in a number of ways. For example, the cavities 30,32 may be formed in the upper surface of the lower spray head part, or mating cavities may be formed in both spray head parts. By properly shaping any of these cavities, the valving represented in FIGS. 3–6, may also be varied to meet any particular needs, for example, by using recesses in the flange 34 which communicate with the trigger-bulb opening.

One of the problems which has been encountered is that, in some uses, the trigger-bulb 14 may tend to fold near its top end, when the trigger is pulled. Depending upon a number of factors, that fold might become a kink or crimp which could cut off all further flow of fluid from the bulb. Then, less than a satisfactory volume of spray might be delivered.

To preclude this possible kinking action, the trigger-bulb 14 and anvil 15 may be modified, as shown at 14A,15A in FIGS. 7, 8. Except for these modifications, the structures and valving of these two FIGS. 7 and 8 are the same as those described in connection with the preceding FIGS. 1–4. In FIGS. 7, 8, the trigger bulb is shown as depending perpendicularly from the flange 34; however, this dependency is optional. Also, the bulb is shown with smooth interior walls, free of the internal thread 44. Again, this is optional.

In FIG. 7, the anvil 15A has a lower projecting profile member 80 which engages the bottom tip end of the bulb 14A. Between the projecting member 80 and the lower spray head member 16, the anvil has a profile at 82 which conforms to a desired manner of bulb flexing. Therefore, when the trigger-bulb 14A is pulled or squeezed (FIG. 8), it tends to deform in an optimum manner and to flatten against the anvil 15A while preventing kinks from forming. Thus, there are no constrictions to impede the flow of fluids within the bulb portion 42. When the trigger-bulb 14A is released, it returns to the configuration seen in FIG. 7. Depending upon the physical characteristics of the fluid being pumped, the anvil profile 82 may be changed to accomplish different ends.

Means are provided for selectively opening or closing the jet oriface at the end of the spray head. In greater detail, the embodiment of FIG. 1 has a nozzle 40 which is rotated to an open position for spraying or to a closed position for storage or transportation. From FIGS. 3 and 5, the valves are closed at 56 and 64 when the trigger-bulb is in its normal and released position. For most fluids, these closed valves are adequate to keep the pump from leaking under most conditions, even when no other cap (e.g., nozzle 40) is provided.

For some uses, still another form of anti-leak device (FIGS. 9, 10) may be necessary or desirable. In greater detail, FIG. 9 shows the spray tip ends as molded (i.e., the end having jet orifice 38 in FIG. 1 is replaced by a restricted groove 38B) of the lower and upper head parts 16B and 18B. The tip end of the lower part 16B terminates in a generally L-shaped member 84 which is integrally joined thereto by means of a living hinge 86. The L-shaped member 84 has an upstanding, dome-shaped boss 88 which is positioned to plug the orifice 38B when the member 84 is moved to a closed position (FIG. 10). In this position, a cove 90 in the L-shaped member 84 snaps over a detent 92 on upper member 18B in order to hold the spray head in a closed position.

Thus, to use the embodiment of FIGS. 9, 10, the cove 90 in L-shaped member 84 is snapped off the detent 92 and member 84 swings downwardly to expose the spray orifice 38B. Thereafter, the L-shaped member 84 may be moved back to a closed position (FIG. 10) where it snap-locks into position for storage or transportation.

Those who are skilled in the art will readily perceive how to modify the system. Therefore, the appended claims are to be construed to cover all equivalent structures which fall within the true scope and spirit of the invention.

I claim:

1. A pump for a fluid container comprising: a two part spray head which fits together to form means for dispensing fluid from the container via passages in at least one of said two parts, said head including a fluid-dispensing nozzle; a first of said parts being shaped and proportioned to provide first means for enabling a flow of fluid from near the bottom of the container to the nozzle; second means interposed in said first means for drawing fluid from said container and for delivering it to and expelling it from said nozzle, said second means further including a flexible trigger means having a flange with contours for forming intake and outlet fluid valves and an air breather valve, and said flexible trigger means contours further forming a thin walled bulb which is dependent from said flange and which is positioned to be in direct contact with a finger on the hand of an operator, said finger first closing and then opening said bulb for sucking in said fluid via said first means and said intake valve and then closing said bulb for expelling fluid via said outlet valve and said nozzle, said valves being operated solely by said finger squeezing said bulb.

2. The pump of claim 1 wherein the contours of said flexible trigger means comprises said flange member having said thin walled bulb dependent therefrom, a hole through said flange leading into the interior of said bulb, and a pair of recesses formed at the upper surface of said flange and being separated from said hole by upstanding walls which form said intake and outlet valves.

3. The pump of claim 2 wherein said two part spray head includes upper and lower parts with the flange of said flexible trigger means captured between said upper and lower parts and with the thin walled bulb projecting below the spray head halves, and a passageway formed by a pair of cavities in at least one of said parts, said cavities being aligned over ends of said recesses and terminating before they reach the upstanding walls whereby said intake and outlet valves are formed by said walls being pressed against one of said spray head parts.

4. The pump of claim 3 wherein a first upper edge wall on said flexible trigger means forms said intake valve which is normally open and a second upstanding wall forming said outlet valve is normally closed by being pressed against an opposing surface of said spray head.

5. The pump of claim 1 wherein the bulb of said trigger is dependent from said spray head and is located at a point where it may be actuated as a trigger, such actuation pressing said flange against an opposing surface to close said intake valve and pulling said flange away from an opposing surface to open said outlet valve.

* * * * *